US009757751B2

(12) United States Patent
Chen

(10) Patent No.: US 9,757,751 B2
(45) Date of Patent: Sep. 12, 2017

(54) COSMETIC CONTAINER

(71) Applicant: Sin-Hsiung Chen, Tainan (TW)

(72) Inventor: Sin-Hsiung Chen, Tainan (TW)

( * ) Notice: Subject to any disclaimer, the term of this patent is extended or adjusted under 35 U.S.C. 154(b) by 0 days.

(21) Appl. No.: 15/078,697

(22) Filed: Mar. 23, 2016

(65) Prior Publication Data

US 2017/0165695 A1 Jun. 15, 2017

(30) Foreign Application Priority Data

Dec. 10, 2015 (TW) ..... 104141607 A

(51) Int. Cl.
*B05B 11/00* (2006.01)
*A45D 40/00* (2006.01)
*A45D 34/00* (2006.01)

(52) U.S. Cl.
CPC ..... *B05B 11/0091* (2013.01); *A45D 40/0075* (2013.01); *B05B 11/0054* (2013.01); *A45D 2034/005* (2013.01)

(58) Field of Classification Search
CPC ..... B05B 11/0054; B05B 11/0027; B05B 11/0032; B05B 11/0091; B65D 83/384; B65D 83/386; B65D 83/56; A45D 2034/005; A45D 2200/05; A45D 2200/054; A45D 2200/055; A45D 2200/056; A45D 2200/057; A45D 40/06; A45D 40/0075; A45D 34/00
See application file for complete search history.

(56) References Cited

U.S. PATENT DOCUMENTS 1,599,348 A * 9/1926 Rieser ..... A45D 34/00 215/12.1
2,998,165 A * 8/1961 De Elorza ..... A45D 34/02 222/182
3,080,989 A * 3/1963 Ramsbotham ..... B65D 83/384 215/12.1
8,439,230 B2 * 5/2013 Hagen ..... B05B 11/3001 222/153.13

(Continued)

FOREIGN PATENT DOCUMENTS

EP 2893833 A1 7/2015
FR 2489116 A1 3/1982

OTHER PUBLICATIONS

Extended European Search Report dated May 15, 2017 of corresponding European application 16161949.9-1653.

*Primary Examiner* — Patrick M Buechner
(74) *Attorney, Agent, or Firm* — Muncy, Geissler, Olds & Lowe, P.C.

(57) ABSTRACT

A cosmetic container has a driving assembly, a vessel, and a shell assembly. The vessel is mounted in the driving assembly. The shell assembly is mounted around a second rotating tube of the driving assembly and the vessel. The shell assembly has a first tube, a second tube, and a top seat. The first tube is coactively mounted around an outer surface of the second rotating tube and has at least one notch formed in an outer surface of the first tube. The second tube is coactively mounted around the first tube and has at least one connecting protrusion inserted into the at least one notch of the first tube. The top seat is coactively mounted on the first tube. The cosmetic container is convenient to assemble and prevents dust accumulation on the assembling structure of the cosmetic container.

20 Claims, 10 Drawing Sheets

(56) References Cited

U.S. PATENT DOCUMENTS

| | | | | |
|---|---|---|---|---|
| 9,044,768 | B2 * | 6/2015 | Pouliaude | B05B 11/0054 |
| 9,399,235 | B2 * | 7/2016 | Drugeon | A45D 34/00 |
| 2008/0023498 | A1 * | 1/2008 | Bertin | B05B 11/0032 222/402.12 |
| 2008/0116232 | A1 * | 5/2008 | Michaux | B05B 11/3049 222/507 |
| 2009/0071985 | A1 * | 3/2009 | Ki | B05B 11/0027 222/309 |
| 2009/0120963 | A1 * | 5/2009 | Bae | B05B 11/0032 222/153.13 |
| 2012/0024899 | A1 * | 2/2012 | Michaux | B65D 83/22 222/153.13 |
| 2012/0292344 | A1 * | 11/2012 | Bertin | B05B 11/0032 222/153.13 |
| 2013/0140330 | A1 * | 6/2013 | Christophe | A45D 34/02 222/153.13 |
| 2013/0200107 | A1 * | 8/2013 | Presche | B05B 11/0032 222/153.13 |
| 2013/0256338 | A1 * | 10/2013 | Moreau | B05B 11/0029 222/153.14 |
| 2014/0097208 | A1 * | 4/2014 | Sauvage | B05B 11/0035 222/183 |
| 2014/0263460 | A1 * | 9/2014 | Chen | B05B 11/0032 222/183 |
| 2015/0102123 | A1 * | 4/2015 | Nichols | A61L 9/127 239/44 |
| 2015/0108171 | A1 * | 4/2015 | Kim | B05B 11/3001 222/321.3 |
| 2016/0037890 | A1 * | 2/2016 | Chen | B05B 11/0032 222/154 |
| 2016/0324294 | A1 * | 11/2016 | Kim | A45D 34/04 |

* cited by examiner

COSMETIC CONTAINER

BACKGROUND OF THE INVENTION

1. Field of the Invention

The present invention relates to a container, and more particularly to a cosmetic container that may be convenient to assemble.

2. Description of Related Art

A conventional cosmetic container has a shell assembly, a driving assembly, and a vessel. The driving assembly is mounted in the shell assembly. The vessel is deposited in the driving assembly. A relative rotation between multiple constituent elements of the shell assembly is driven by users for driving the driving assembly. A head of the shell assembly may protrude out of or may be retracted in the shell assembly by the driving assembly for hygiene and operation.

Due to the linking-up relationships among the constituent elements of the shell assembly and multiple constituent elements of the driving assembly, the engaging elements between the conventional cosmetic container and the driving assembly are numerous and the assembling structure is complex. The assembly of the conventional cosmetic container is inconvenient. Moreover, the assembling structure of the conventional cosmetic container is exposed, and this may influence the appearance of the conventional cosmetic container and dust easily accumulates on the assembling structure of the conventional cosmetic container.

To overcome the shortcomings, the present invention tends to provide a cosmetic container to mitigate or obviate the aforementioned problems.

SUMMARY OF THE INVENTION

The main objective of the invention is to provide a cosmetic container that may be convenient to assemble and prevent dust accumulation on assembling structures of the cosmetic container.

The cosmetic container has a driving assembly, a vessel, and a shell assembly. The driving assembly has a first rotating tube, a second rotating tube and a moving seat. The first rotating tube has a top end and a bottom end. The second rotating tube is rotatably mounted around the first rotating tube adjacent to the top end of the first rotating tube and has an outer surface. The moving seat is rotatably mounted in the first rotating tube. The vessel is mounted in the moving seat of the driving assembly.

The shell assembly is mounted around the driving assembly and the vessel. The shell assembly has a bottom seat, a first tube, a second tube and a top seat.

The bottom seat is coactively mounted on the bottom end of the first rotating tube of the driving assembly.

The first tube is coactively mounted around the outer surface of the second rotating tube of the driving assembly and is mounted around the first rotating tube above the bottom seat. The first tube has an outer surface, an inner surface, a top side, at least one notch and two retaining members. The at least one notch is axially formed in the outer surface of the first tube and extends to the top side of the first tube. The retaining members are formed on the inner surface of the first tube and are opposite each other. Each retaining member has a retaining groove, a retaining protrusion, a retaining section, and a connecting groove. The retaining groove is radially formed in the inner surface of the first tube, and extends to the outer surface of the first tube adjacent to the top side of the first tube. The retaining groove has a first face, a second face and a bottom face. The first face is radially formed in the inner surface of the first tube and extends to the outer surface of the first tube. The second face is opposite the first face. The bottom face is connected to the first face and the second face. The retaining protrusion is formed on and protrudes from the bottom face in the retaining groove. The retaining section is formed between the retaining protrusion and the first face of the retaining groove. The connecting groove is axially formed on the inner surface of the first tube and extends from the top side of the first tube to the second face of the retaining groove.

The second tube is coactively mounted around the first tube and is mounted around the first rotating tube above the bottom seat. The second tube has an inner surface and at least one connecting protrusion. The at least one connecting protrusion is formed on and protrudes from the inner surface of the second tube and is inserted into the at least one notch of the first tube.

The top seat is hollow, is coactively mounted on the first tube, abuts the second tube, and has two retaining pins. The two retaining pins are formed on the top seat, respectively pass through the two retaining members, are respectively located at the two retaining sections, and respectively abut the two retaining protrusions.

The at least one notch receives the at least one connecting protrusion. The second tube is coactively mounted around the first tube quickly and conveniently. The top seat may be pressed downwardly. The retaining pins of the top seat are inserted into the retaining grooves via the connecting grooves. The top seat may be rotated by users. The retaining pins of the top seat pass through the retaining protrusions and are located at the retaining sections. The top seat is coactively and conveniently mounted on the first tube.

In addition, the at least one connecting protrusion is formed on the inner surface of the second tube. The at least one notch and the at least one connecting protrusion are hidden in and are not exposed out of the second tube. The retaining members and the retaining pins are not exposed out of the second tube, too. The aesthetic appearance of the cosmetic container is improved. Dust is difficult to accumulate on the at least one notch and the retaining members of the cosmetic container.

Other objects, advantages and novel features of the invention will become more apparent from the following detailed description when taken in conjunction with the accompanying drawings.

DETAILED DESCRIPTION OF PREFERRED EMBODIMENT

Figure 1:
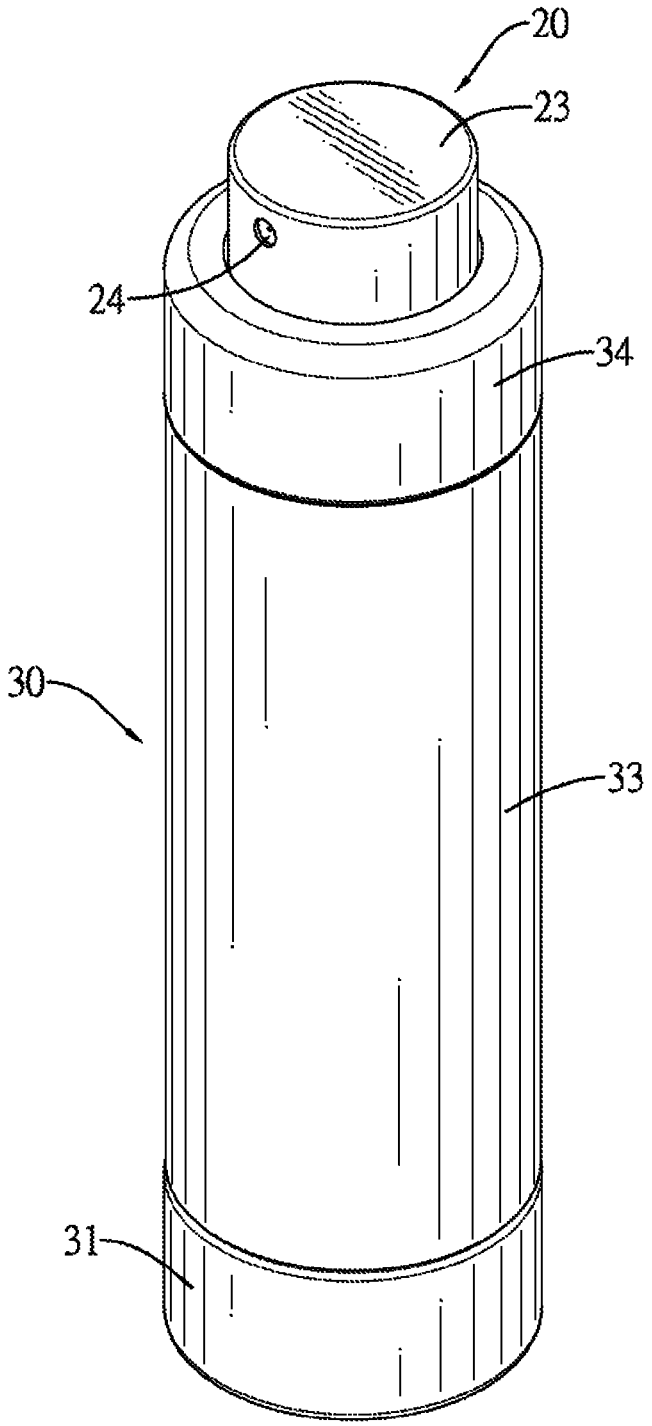
FIG. 1 is a perspective view of a cosmetic container in accordance with the present invention.
Figure 2:
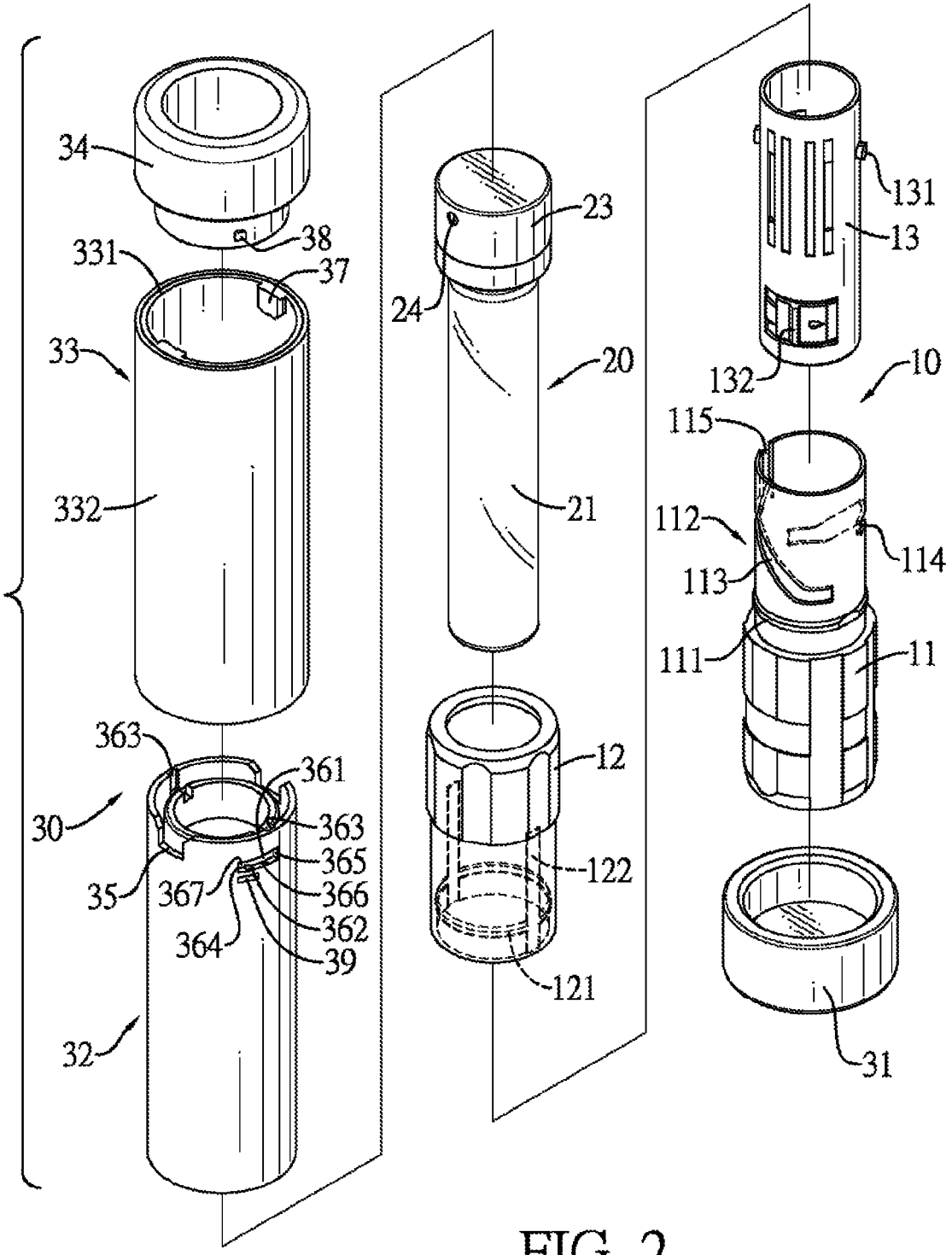
FIG. 2 is an exploded perspective view of the cosmetic container in FIG. 1.

With reference to FIGS. 1 and 2, a cosmetic container in accordance with the present invention comprises a driving assembly 10, a vessel 20, and a shell assembly 30.

Figure 4:
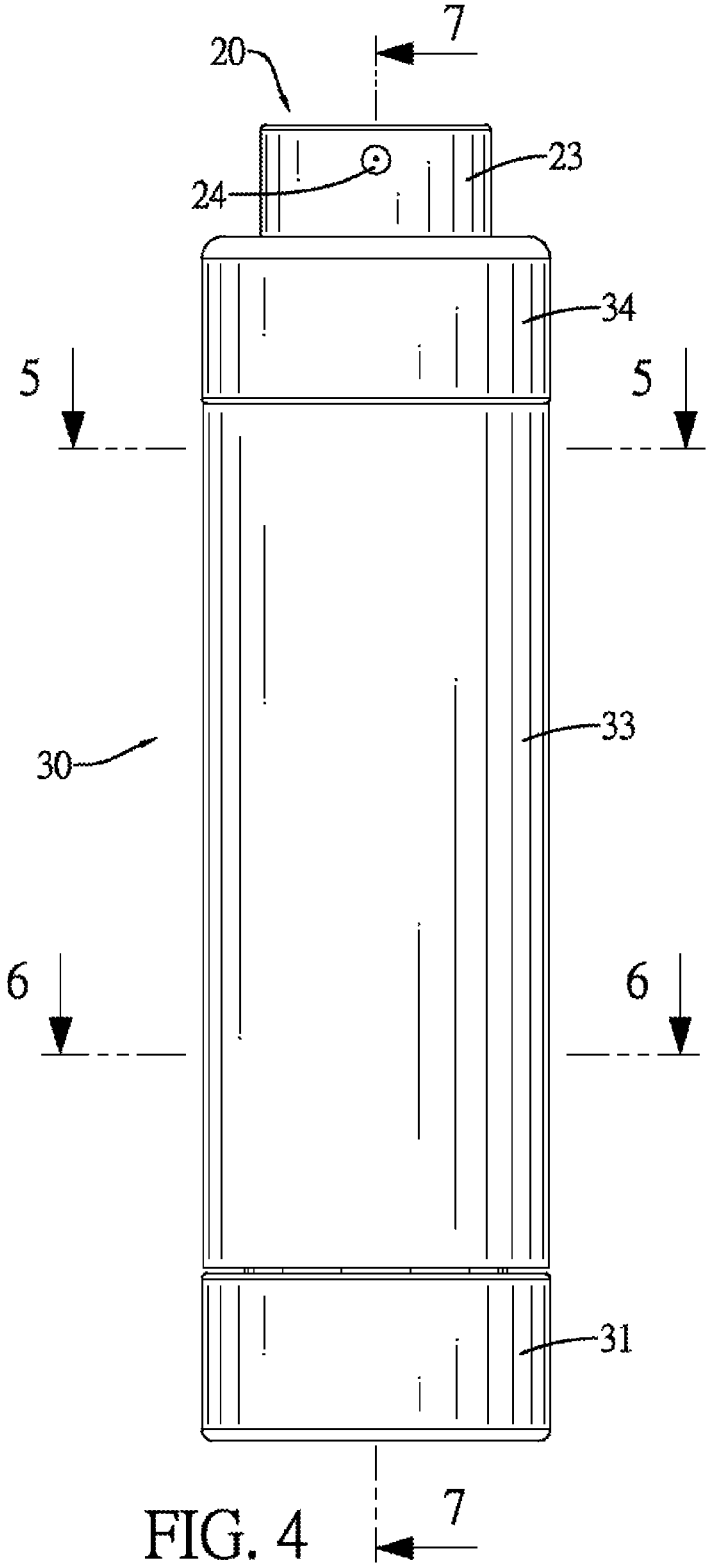
FIG. 4 is a front side view of the cosmetic container in FIG. 1.
Figure 5:
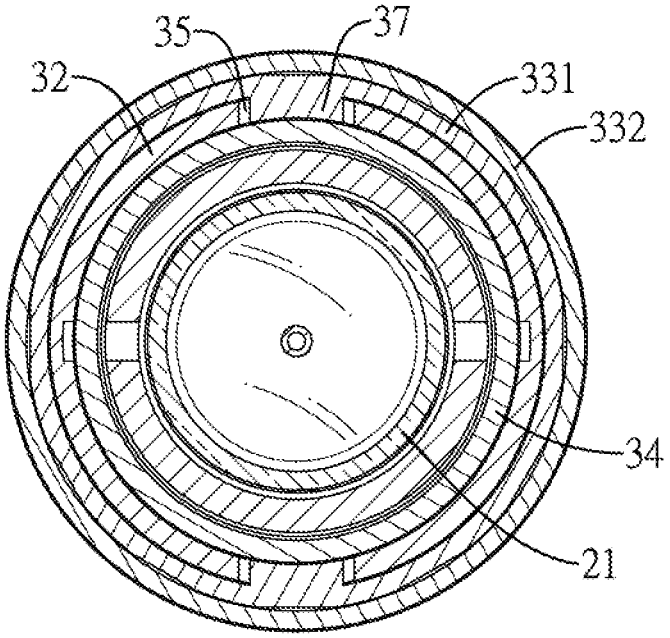
FIG. 5 is an enlarged top view in partial section of the cosmetic container along line 5-5 in FIG. 4.
Figure 7:
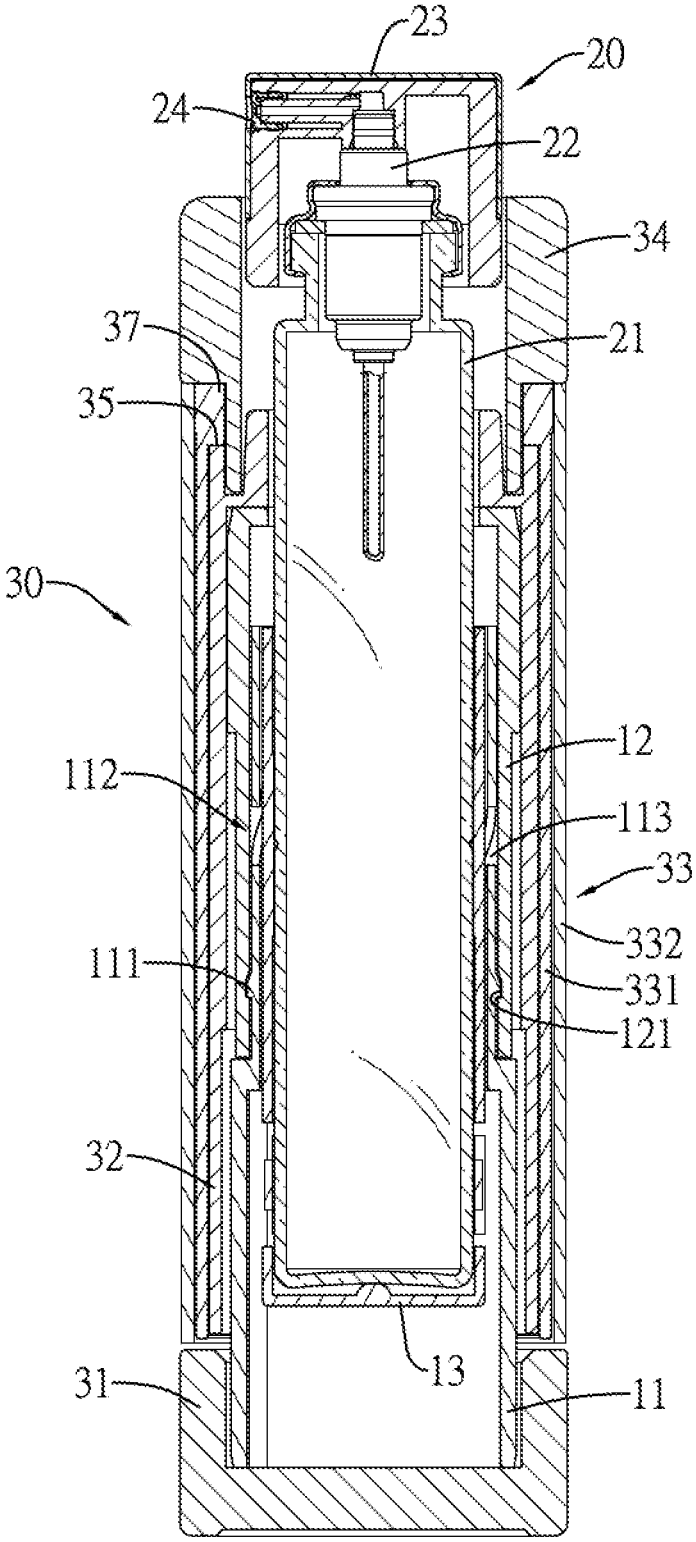
FIG. 7 is a side view in partial section of the cosmetic container along line 7-7 in FIG. 4.

With reference to FIGS. 2, 4, and 7, the driving assembly 10 has a first rotating tube 11, a second rotating tube 12, and a moving seat 13. The first rotating tube 11 has a top end and a bottom end. The second rotating tube 12 is rotatably mounted around the first rotating tube 11 adjacent to the top end of the first rotating tube 11 and has an outer surface. The moving seat 13 is rotatably mounted in the first rotating tube 11 and moves upwardly and downwardly.

The vessel 20 is mounted in the moving seat 13 of the driving assembly 10. The vessel 20 has a body 21, a chamber, a nozzle 22, a cap 23, and an outlet 24. The body 21 is mounted in the moving seat 13. The chamber is formed in the body 21. The nozzle 22 is mounted on the body 21 and communicates with the chamber of the body 21. The cap 23 is mounted around the nozzle 22 above the body 21. The outlet 24 is formed in the cap 23 and communicates with the chamber of the body 21 via the nozzle 22.

The shell assembly 30 is mounted around the driving assembly 10 and the vessel 20. The shell assembly 30 has a bottom seat 31, a first tube 32, a second tube 33, and a top seat 34. The bottom seat 31 is coactively mounted on the bottom end of the first rotating tube 11 of the driving assembly 10. With reference to FIGS. 2, 5, 7 and 8, the first tube 32 is coactively mounted around the outer surface of the second rotating tube 12 of the driving assembly 10 and is mounted around the first rotating tube 11 above the bottom seat 31. The first tube 32 has an outer surface, an inner surface, a top side, at least one notch 35, and two retaining members 36. The at least one notch 35 is axially formed in the outer surface of the first tube 32 and extends to the top side of the first tube 32. The retaining members 36 are formed on the inner surface of the first tube 32 and are opposite each other. Each retaining member 36 has a retaining groove 361, a retaining protrusion 362, and a connecting groove 363.

The retaining groove 361 is radially formed in the inner surface of the first tube 32 and extends to the outer surface of the first tube 32 adjacent to the top side of the first tube 32. The retaining groove 361 has a first face 364, a second face 365, and a bottom face 366. The first face 364 is radially formed in the inner surface of the first tube 32 and extends to the outer surface of the first tube 32. The second face 365 is opposite the first face 364. The bottom face 366 is connected to the first face 364 and the second face 365. The retaining protrusion 362 is formed on and protrudes from the bottom face 366 in the retaining groove 361. A retaining section 367 is formed between the retaining protrusion 362 and the first face 364 of the retaining groove 361. The connecting groove 363 is axially formed in the inner surface of the first tube 32, and extends from the top side of the first tube 32 to the second face 365 of the retaining groove 361.

Figure 8:
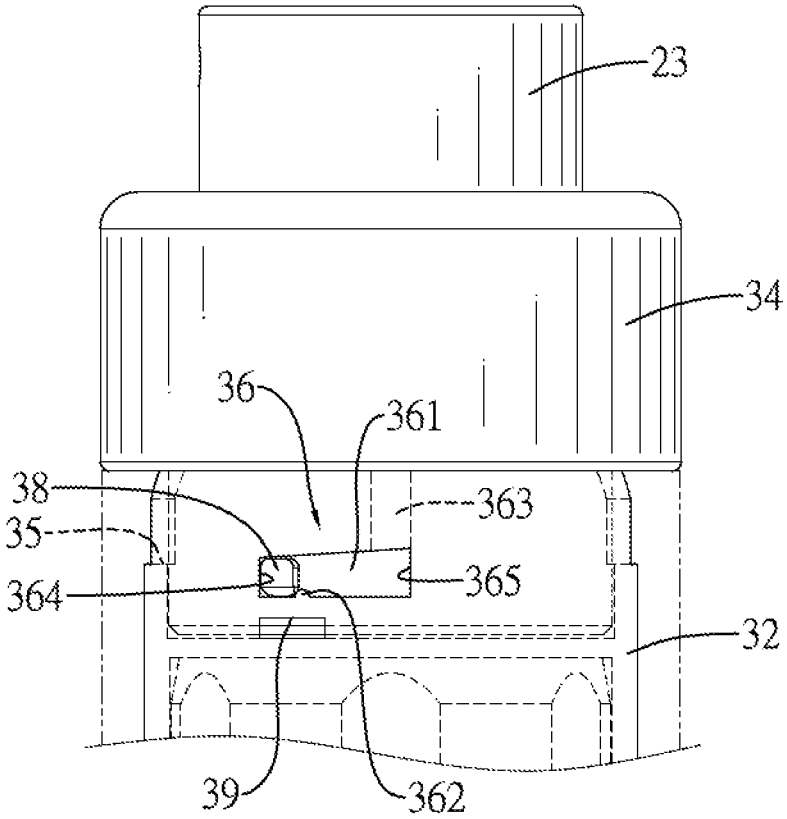
FIG. 8 is an enlarged side view in partial section of the cosmetic container in FIG. 1, showing a retaining pin positioned in a retaining member of the cosmetic container.

With reference to FIGS. 2 and 8, the first tube 32 has two deformable grooves 39. The two deformable grooves 39 are radially formed in the inner surface of the first tube 32 and extend to the outer surface of the first tube 32. The two deformable grooves 39 are respectively spaced apart from the two retaining grooves 361, and are respectively below the two retaining protrusions 362 of the two retaining members 36.

The second tube 33 is coactively mounted around the first tube 32 and is mounted around the first rotating tube 11 above the bottom seat 31. The second tube 33 has an inner surface and at least one connecting protrusion 37. The at least one connecting protrusion 37 is formed on and protrudes from the inner surface of the second tube 33 and is inserted into the at least one notch 35 of the first tube 32 to coactively fix the second tube 33 on the first tube 32. The at least one connecting protrusion 37 extends to the top surface of the second tube 33. The second tube 33 covers the retaining grooves 361 and the deformable grooves 39 of the first tube 32.

Figure 3:
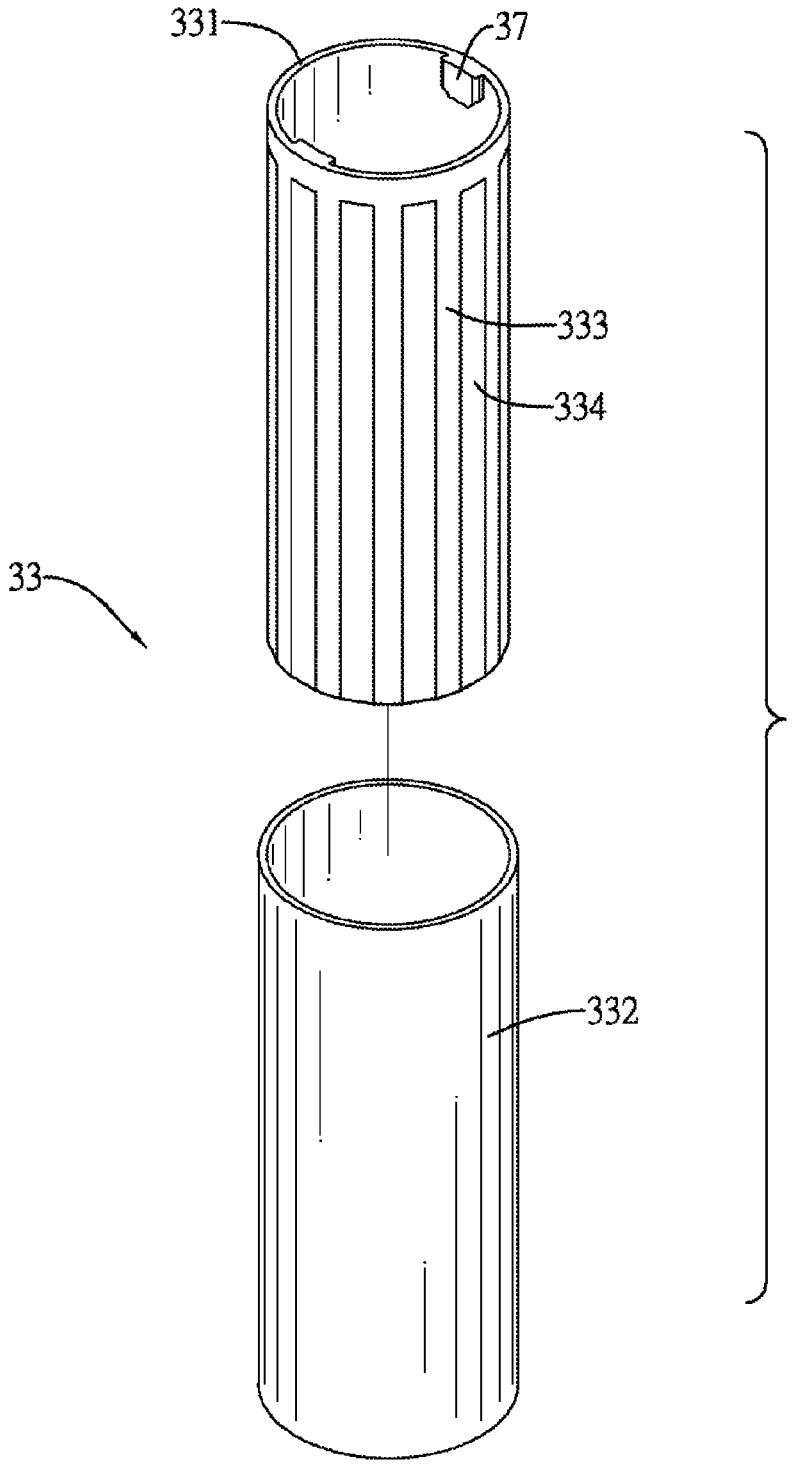
FIG. 3 is a further exploded perspective view of a second tube of the cosmetic container in FIG. 2.

The second tube 33 may be a single member or a composite member as shown in FIG. 3. The second tube 33 has an inner element 331 and an outer element 332. The inner element 331 is mounted around the first tube 32 and has an inner surface forming the at least one connecting protrusion 37. Furthermore, the inner element 331 has an outer surface, multiple connecting surfaces 333, and multiple planes 334.

The connecting surfaces 333 and the planes 334 are axially formed on the outer surface of the inner element 331 and are alternately arranged. The outer element 332 is mounted around the outer surface of the inner element 331 and abuts the connecting surfaces 333 of the inner element 331. The outer element 332 does not abut the planes 334 of the inner element 331, thereby reducing the friction between the inner element 331 and the outer element 332. The convenience of the assembly of the inner element 331 and the outer element 332 is improved by the planes 334 of the inner element 331. In addition, the material of the inner element 331 and the material of the outer element 332 may be same or different.

With reference to FIGS. 2 and 8, the top seat 34 is hollow, is coactively mounted on the first tube 32 and abuts the second tube 33. The top seat 34 has two retaining pins 38. The two retaining pins 38 are formed on the top seat 34, respectively pass through the two retaining members 36, are respectively located at the two retaining sections 367, and respectively abut the two retaining protrusions 362 to position the top seat 34 on the first tube 32 coactively.

Figure 11:
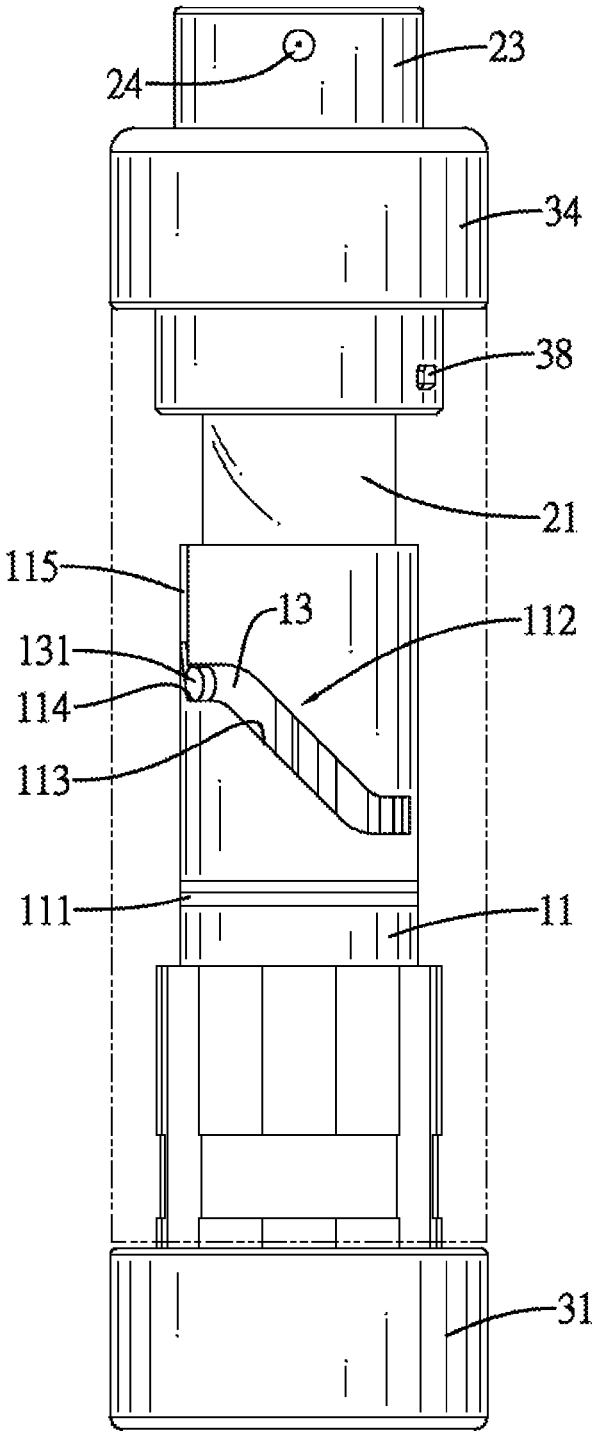
FIG. 11 is a front side view in partial section of the cosmetic container in FIG. 1, showing a guiding protrusion moving along a chute of the cosmetic container.

With reference to FIGS. 2 and 11, the first rotating tube 11 has an outer surface, a top surface, an annular flange 111, and multiple chutes 112. The annular flange 111 is formed on the outer surface of the first rotating tube 11 between the top end of the first rotating tube 11 and the bottom end of the first rotating tube 11. The chutes 112 are formed through the outer surface of the first rotating tube 11 above the annular flange 111. Each chute 112 has a slanting section 113 and a transverse section 114. The slanting section 113 is aslant formed through the outer surface of the first rotating tube 11 above the annular flange 111 and has a top end. The transverse section 114 is formed through the outer surface of the first rotating tube 11 above the annular flange 111, is connected to the top end of the slanting section 113 and has a distal end. One of the chutes 112 further has a longitudinal section 115. The longitudinal section 115 is formed on the distal end of the corresponding transverse section 114 and extends to the top surface of the first rotating tube 11.

The second rotating tube 12 has an inner surface, an annular groove 121, and multiple longitudinal grooves 122. The annular groove 121 is formed in the inner surface of the second rotating tube 12 and receives the annular flange 111 of the first rotating tube 11. Thus, the second rotating tube 12 is rotatably mounted around the first rotating tube 11 and does not come off the first rotating tube 11. The moving seat 13 has an outer surface and multiple guiding protrusions 131 formed on the outer surface of the moving seat 13. The guiding protrusions 131 are respectively inserted through the chutes 112 of the first rotating tube 11 and respectively inserted into the longitudinal grooves 122 of the second rotating tube 12. When the first rotating tube 11 is rotated, the guiding protrusions 131 may climb along the chutes 112 of the first rotating tube 11 and move along the longitudinal grooves 122 of the second rotating tube 12 simultaneously.

Figure 6:
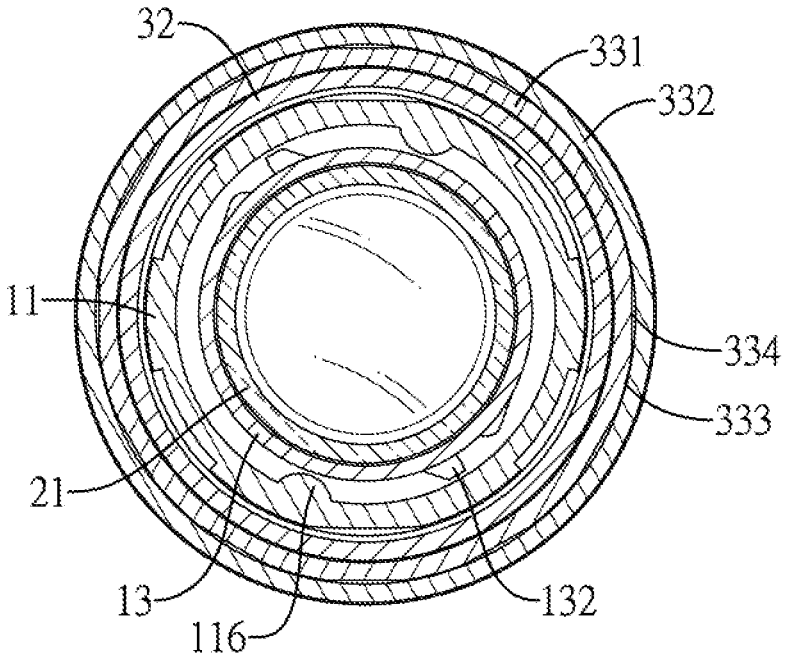
FIG. 6 is an enlarged top view in partial section of the cosmetic container along line 6-6 in FIG. 4.

With reference to FIG. 6, the first rotating tube 11 has an inner surface and multiple ribs 116 formed on the inner surface of the first rotating tube 11. The moving seat 13 has multiple positioning members 132. The positioning members 132 are formed on the outer surface of the moving seat 13 and respectively abut the ribs 116 of the first rotating tube 11.

In assembly, the bottom seat 31 of the shell assembly 30 is fixedly mounted around the bottom end of the first rotating tube 11 of the driving assembly 10. The first tube 32 of the shell assembly 30 is securely mounted around the outer surface of the second rotating tube 12 of the driving assembly 10. The second tube 33 is further securely mounted around the first tube 32. The at least one connecting protrusion 37 of the second tube 33 is inserted into the at least one notch 35 of the first tube 32 to enable the second tube 33 to engage with the first tube 32. Then, the first tube 32 co-acts with the second tube 33. The retaining pins 38 of the top seat 34 align with the connecting grooves 363 of the retaining members 36 of the first tube 32. When the retaining pins 38 align with the connecting grooves 363, the top seat 34 may be pressed downward relative to the second tube 33.

In addition, when the retaining pins 38 slide into the retaining grooves 361 near the first faces 364, the top seat 34 is rotated relative to the first tube 32. The retaining pins 38 pass through the retaining protrusions 362 and move into the retaining sections 367. When the retaining pins 38 pass through the retaining protrusions 362, the retaining protrusions 362 are pressed downward by the retaining pins 38. The deformable grooves 39 below the retaining protrusions 362 are deformed. The retaining protrusions 362 are easy to move downward. Then, the retaining pins 38 may pass through the retaining protrusions 362 smoothly. The top seat 34 is further securely mounted on the first tube 32. The body 21 of the vessel 20 is inserted through the top seat 34 and is securely mounted on the moving seat 13 of the driving assembly 10.

Figure 9:
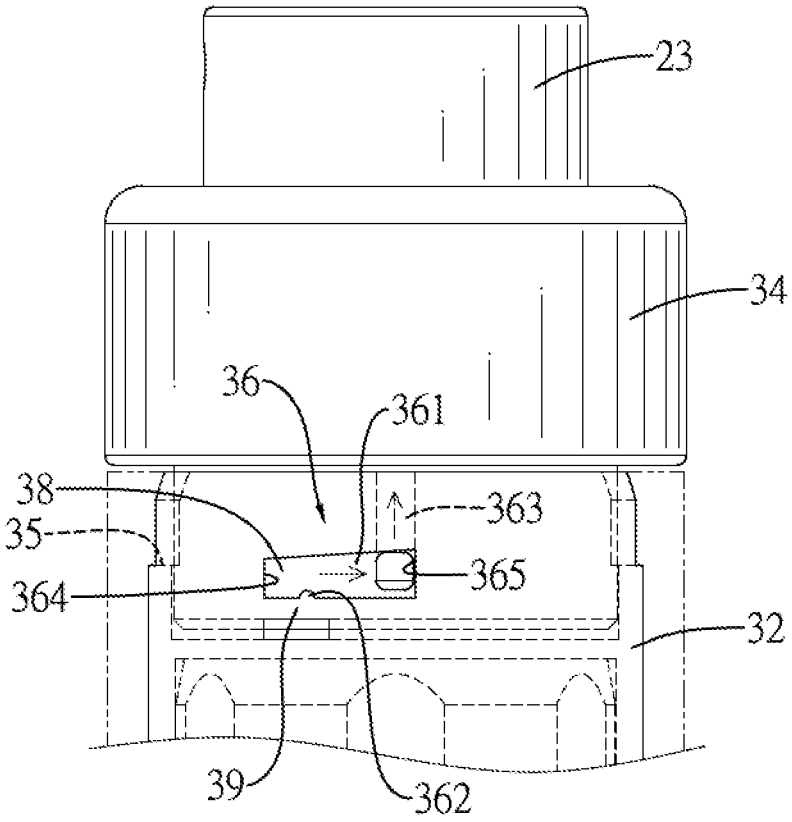
FIG. 9 is an enlarged side view in partial section of the cosmetic container in FIG. 1, showing the retaining pin moved to a second face of the retaining member of the cosmetic container.
Figure 10:
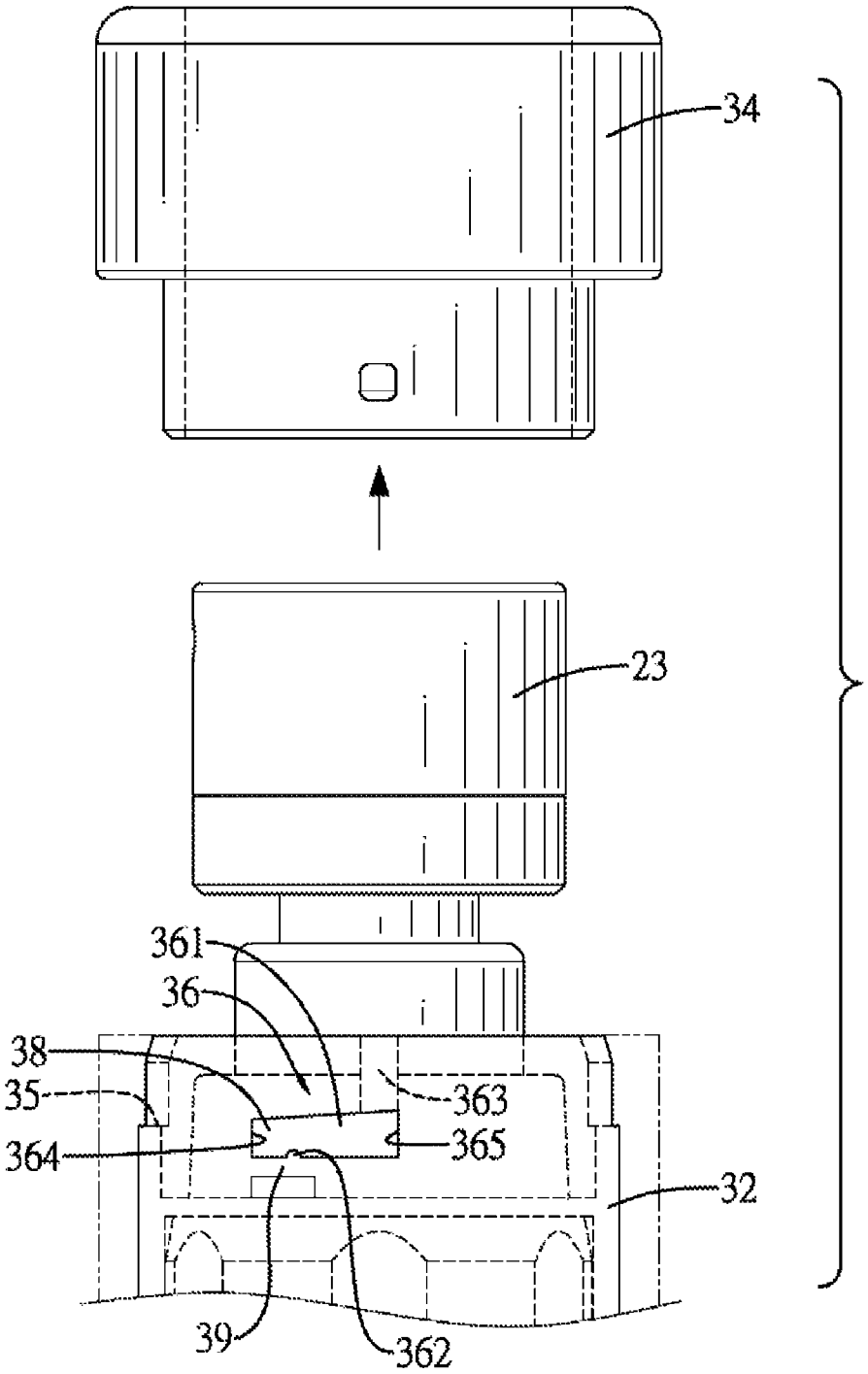
FIG. 10 is an enlarged side view in partial section of the cosmetic container in FIG. 1, showing the retaining pin moved out of the retaining member of the cosmetic container.

With reference to FIGS. 8, 9, and 10, the top seat 34 may be rotated by users. The retaining pins 38 of the top seat 34 pass through the retaining protrusions 362 and move out of the retaining sections 367. The top seat 34 may be pulled upward by users. The retaining pins 38 pass through the connecting grooves 363 and move out of the first tube 32. The second tube 33 may be pulled upward by users. The at least one connecting protrusion 37 of the second tube 33 moves upward and moves out of the at least one notch 35 of the first tube 32. It is easy to take the second tube 33 out of the first tube 32 for replacement. The aesthetic appearance of the cosmetic container is improved. In addition, the vessel 20 may be pulled out of the moving seat 13 by users for replacement.

In operation, users may hold the second tube 33 and rotate the bottom seat 31. The first tube 32, the top seat 34, and the second rotating tube 12 are fixed on the second tube 33. The first rotating tube 11 is rotated by the bottom seat 31. The guiding protrusions 131 of the moving seat 13 move along the chutes 112 of the first rotating tube 11 and move along the longitudinal grooves 122 downwardly and upwardly. The vessel 20 is moved downwardly and upwardly by the moving seat 13. The outlet 24 of the vessel 20 is retracted and hidden in the top seat 34.

Accordingly, the second tube 33 is mounted around the first tube 32. The at least one connecting protrusion 37 of the second tube 33 is inserted into the at least one notch 35 of the first tube 32, so the second tube 33 may be coactively assembled with the first tube 32 quickly and conveniently. In addition, the top seat 34 may be pressed and rotated. The retaining pins 38 of the top seat 34 pass through the connecting grooves 363 and the retaining grooves 361 of the first tube 32. The retaining pins 38 of the top seat 34 slide into the retaining sections 367 and abut the retaining protrusions 362. Since the top seat 34 is mounted on the first tube 32 securely and conveniently, the first tube 32, the second tube 33 and the top seat 34 are convenient to assemble.

In addition, the at least one connecting protrusion 37 is formed in the inner surface of the second tube 33 and is hidden in the second tube 33. When the at least one connecting protrusion 37 is inserted into the at least one notch 35, the at least one notch 35 is covered by the second tube 33, and the at least one notch 35 is not exposed out of the second tube 33. The retaining grooves 361, the deformable grooves 39 of the first tube 32, and the retaining pins 38 of the top seat 34 are covered by the second tube 33 and are not exposed out of the second tube 33, either. The aesthetic appearance of the cosmetic container is improved. Dust is difficult to accumulate on the at least one notch 35 and the retaining members 36 of the cosmetic container.

Besides, the top seat 34 and the second tube 33 are easy to take apart from the first tube 32. The vessel 20 may be pulled out of the moving seat 13 by users. It is convenient to change to another top seat 34, another second tube 33 or another vessel 20.

What is claimed is:

1. A cosmetic container comprising:

a driving assembly having a first rotating tube having a top end and a bottom end;

a second rotating tube rotatably mounted around the first rotating tube adjacent to the top end of the first rotating tube and having an outer surface; and a moving seat rotatably mounted in the first rotating tube;

a vessel mounted in the moving seat of the driving assembly; and a shell assembly mounted around the driving assembly and the vessel, and having a bottom seat coactively mounted on the bottom end of the first rotating tube of the driving assembly;

a first tube coactively mounted around the outer surface of the second rotating tube of the driving assembly, mounted around the first rotating tube above the bottom seat, and having an outer surface;

an inner surface;

a top side;

at least one notch axially formed in the outer surface of the first tube and extending to the top side of the first tube; and two retaining members formed on the inner surface of the first tube, being opposite each other, and each retaining member having a retaining groove radially formed in the inner surface of the first tube, extending to the outer surface of the first tube adjacent to the top side of the first tube, and having a first face radially formed in the inner surface of the first tube and extending to the outer surface of the first tube;

a second face opposite the first face; and a bottom face connected to the first face and the second face;

a retaining protrusion formed on and protruding from the bottom face in the retaining groove;

a retaining section formed between the retaining protrusion and the first face of the retaining groove; and a connecting groove axially formed in the inner surface of the first tube, and extending from the top side of the first tube to the second face of the retaining groove;

a second tube coactively mounted around the first tube, mounted around the first rotating tube above the bottom seat, and having an inner surface; and at least one connecting protrusion formed on and protruding from the inner surface of the second tube and inserted into the at least one notch of the first tube; and a top seat being hollow, coactively mounted on the first tube, abutting the second tube, and having two retaining pins formed on the top seat, respectively passing through the two retaining members, respectively located at the two retaining sections, and respectively abutting the two retaining protrusions.

2. The cosmetic container as claimed in claim 1, wherein the at least one notch extends to the top side of the first tube, the second tube has a top surface, and the at least one connecting protrusion extends to the top surface of the second tube.

3. The cosmetic container as claimed in claim 1, wherein the vessel has a body mounted in the moving seat;

a chamber formed in the body;

a nozzle mounted on the body and communicating with the chamber of the body;

a cap mounted around the nozzle above the body; and an outlet formed in the cap, communicating with the chamber of the body via the nozzle, and protruding out of the top seat of the shell assembly selectively.

4. The cosmetic container as claimed in claim 1, wherein the first rotating tube has an outer surface;

a top surface;

an annular flange formed on the outer surface of the first rotating tube between the top end of the first rotating tube and the bottom end of the first rotating tube;

multiple chutes formed through the outer surface of the first rotating tube above the annular flange, and each chute having a slanting section aslant formed through the outer surface of the first rotating tube above the annular flange and having a top end; and a transverse section formed through the outer surface of the first rotating tube above the annular flange, connected to the top end of the slanting section, and having a distal end; and one of the chutes having a longitudinal section formed on the distal end of the corresponding transverse section and extending to the top surface of the first rotating tube;

the second rotating tube has an inner surface;

an annular groove formed in the inner surface of the second rotating tube and receiving the annular flange of the first rotating tube; and multiple longitudinal grooves formed in the inner surface of the second rotating tube; and the moving seat has an outer surface;

multiple guiding protrusions formed on the outer surface of the moving seat, respectively inserted through the chutes of the first rotating tube, and respectively inserted into the longitudinal grooves of the second rotating tube.

5. The cosmetic container as claimed in claim 4, wherein the first rotating tube has an inner surface; and multiple ribs formed on the inner surface of the first rotating tube; and the moving seat has multiple positioning members formed on the outer surface of the moving seat and respectively abutting the ribs of the first rotating tube.

6. The cosmetic container as claimed in claim 1, wherein the first tube has two deformable grooves radially formed in the inner surface of the first tube and extending to the outer surface of the first tube, respectively spaced apart from the two retaining grooves, and being respectively below the two retaining protrusions of the two retaining members.

7. The cosmetic container as claimed in claim 6, wherein the at least one notch extends to the top side of the first tube, the second tube has a top surface, and the at least one connecting protrusion extends to the top surface of the second tube.

8. The cosmetic container as claimed in claim 6, wherein the first rotating tube has an outer surface;

a top surface;

an annular flange formed on the outer surface of the first rotating tube between the top end of the first rotating tube and the bottom end of the first rotating tube;

multiple chutes formed through the outer surface of the first rotating tube above the annular flange, and each chute having a slanting section aslant formed through the outer surface of the first rotating tube above the annular flange and having a top end; and a transverse section formed through the outer surface of the first rotating tube above the annular flange, connected to the top end of the slanting section, and having a distal end; and one of the chutes having a longitudinal section formed on the distal end of the corresponding transverse section and extending to the top surface of the first rotating tube;

the second rotating tube has
an inner surface;
an annular groove formed in the inner surface of the second rotating tube and receiving the annular flange of the first rotating tube; and
multiple longitudinal grooves formed in the inner surface of the second rotating tube; and
the moving seat has
an outer surface;
multiple guiding protrusions formed on the outer surface of the moving seat, respectively inserted through the chutes of the first rotating tube, and respectively inserted into the longitudinal grooves of the second rotating tube.

9. The cosmetic container as claimed in claim 8, wherein
the first rotating tube has
an inner surface; and
multiple ribs formed on the inner surface of the first rotating tube; and
the moving seat has
multiple positioning members formed on the outer surface of the moving seat and respectively abutting the ribs of the first rotating tube.

10. The cosmetic container as claimed in claim 1, wherein
the second tube has
an inner element mounted around the first tube and having
an inner surface forming the at least one connecting protrusion; and
an outer surface; and
an outer element mounted around the outer surface of the inner element.

11. The cosmetic container as claimed in claim 10, wherein the at least one notch extends to the top side of the first tube, the second tube has a top surface, and the at least one connecting protrusion extends to the top surface of the second tube.

12. The cosmetic container as claimed in claim 10, wherein
the first rotating tube has
an outer surface;
a top surface;
an annular flange formed on the outer surface of the first rotating tube between the top end of the first rotating tube and the bottom end of the first rotating tube;
multiple chutes formed through the outer surface of the first rotating tube above the annular flange, and each chute having
a slanting section aslant formed through the outer surface of the first rotating tube above the annular flange and having a top end; and
a transverse section formed through the outer surface of the first rotating tube above the annular flange, connected to the top end of the slanting section, and having a distal end; and
one of the chutes having
a longitudinal section formed on the distal end of the corresponding transverse section and extending to the top surface of the first rotating tube;
the second rotating tube has
an inner surface;
an annular groove formed in the inner surface of the second rotating tube and receiving the annular flange of the first rotating tube; and
multiple longitudinal grooves formed in the inner surface of the second rotating tube; and
the moving seat has
an outer surface;
multiple guiding protrusions formed on the outer surface of the moving seat, respectively inserted through the chutes of the first rotating tube, and respectively inserted into the longitudinal grooves of the second rotating tube.

13. The cosmetic container as claimed in claim 12, wherein
the first rotating tube has
an inner surface; and
multiple ribs formed on the inner surface of the first rotating tube; and
the moving seat has
multiple positioning members formed on the outer surface of the moving seat and respectively abutting the ribs of the first rotating tube.

14. The cosmetic container as claimed in claim 10, wherein the first tube has two deformable grooves radially formed in the inner surface of the first tube and extending to the outer surface of the first tube, respectively spaced apart from the two retaining grooves, and being respectively below the two retaining protrusions of the two retaining members.

15. The cosmetic container as claimed in claim 14, wherein
the first rotating tube has
an outer surface;
a top surface;
an annular flange formed on the outer surface of the first rotating tube between the top end of the first rotating tube and the bottom end of the first rotating tube;
multiple chutes formed through the outer surface of the first rotating tube above the annular flange, and each chute having
a slanting section aslant formed through the outer surface of the first rotating tube above the annular flange and having a top end; and
a transverse section formed through the outer surface of the first rotating tube above the annular flange, connected to the top end of the slanting section, and having a distal end; and
one of the chutes having
a longitudinal section formed on the distal end of the corresponding transverse section and extending to the top surface of the first rotating tube;
the second rotating tube has
an inner surface;
an annular groove formed in the inner surface of the second rotating tube and receiving the annular flange of the first rotating tube; and
multiple longitudinal grooves formed in the inner surface of the second rotating tube; and
the moving seat has
an outer surface;
multiple guiding protrusions formed on the outer surface of the moving seat, respectively inserted through the chutes of the first rotating tube, and respectively inserted into the longitudinal grooves of the second rotating tube.

16. The cosmetic container as claimed in claim 15, wherein
the first rotating tube has
an inner surface; and
multiple ribs formed on the inner surface of the first rotating tube; and the moving seat has multiple positioning members formed on the outer surface of the moving seat and respectively abutting the ribs of the first rotating tube.

17. The cosmetic container as claimed in claim 14, wherein the at least one notch extends to the top side of the first tube, the second tube has a top surface, and the at least one connecting protrusion extends to the top surface of the second tube.

18. The cosmetic container as claimed in claim 17, wherein the first rotating tube has an outer surface;

a top surface;

an annular flange formed on the outer surface of the first rotating tube between the top end of the first rotating tube and the bottom end of the first rotating tube;

multiple chutes formed through the outer surface of the first rotating tube above the annular flange, and each chute having a slanting section aslant formed through the outer surface of the first rotating tube above the annular flange and having a top end; and a transverse section formed through the outer surface of the first rotating tube above the annular flange, connected to the top end of the slanting section, and having a distal end; and one of the chutes having a longitudinal section formed on the distal end of the corresponding transverse section and extending to the top surface of the first rotating tube;

the second rotating tube has an inner surface;

an annular groove formed in the inner surface of the second rotating tube and receiving the annular flange of the first rotating tube; and multiple longitudinal grooves formed in the inner surface of the second rotating tube; and the moving seat has an outer surface;

multiple guiding protrusions formed on the outer surface of the moving seat, respectively inserted through the chutes of the first rotating tube, and respectively inserted into the longitudinal grooves of the second rotating tube.

19. The cosmetic container as claimed in claim 18, wherein the first rotating tube has an inner surface; and multiple ribs formed on the inner surface of the first rotating tube; and the moving seat has multiple positioning members formed on the outer surface of the moving seat and respectively abutting the ribs of the first rotating tube.

20. The cosmetic container as claimed in claim 19, wherein the vessel has a body mounted in the moving seat;

a chamber formed in the body;

a nozzle mounted on the body and communicating with the chamber of the body;

a cap mounted around the nozzle above the body; and an outlet formed in the cap, communicating with the chamber of the body via the nozzle, and protruding out of the top seat of the shell assembly selectively.

* * * * *